US006208068B1

(12) United States Patent
Lee et al.

(10) Patent No.: US 6,208,068 B1
(45) Date of Patent: Mar. 27, 2001

(54) CATHODE RAY TUBE

(75) Inventors: Bong-woo Lee; Sang-hyuk Yoon, both of Kyungki-do (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/243,968

(22) Filed: Feb. 4, 1999

(30) Foreign Application Priority Data

Sep. 19, 1998 (KR) ..... 98-38811

(51) Int. Cl.[7] ..... H01J 29/76
(52) U.S. Cl. ..... 313/477 R; 313/440
(58) Field of Search ..... 313/477 R, 440; 220/2.1 A

(56) References Cited

U.S. PATENT DOCUMENTS

| | | | | |
|---|---|---|---|---|
| 3,731,129 | | 5/1973 | Tsuneta et al. | 313/64 |
| 5,763,995 | | 6/1998 | Sano et al. | 313/477 |
| 5,929,559 | * | 7/1999 | Sano et al. | 313/477 R |
| 5,962,964 | * | 10/1999 | Sano et al. | 313/440 |
| 6,002,203 | * | 12/1999 | Yokota et al. | 313/477 |
| 6,087,767 | * | 7/2000 | Sano et al. | 313/440 |

FOREIGN PATENT DOCUMENTS

| | | |
|---|---|---|
| 9-306388 | 11/1997 | (JP) . |
| 10-149785 | 6/1998 | (JP) . |

* cited by examiner

*Primary Examiner*—Frank G. Font
*Assistant Examiner*—Layla Lauchman
(74) *Attorney, Agent, or Firm*—Christie, Parker & Hale, LLP

(57) ABSTRACT

A cathode ray tube includes a rectangular panel on which a phosphor screen is formed, a neck in which an electron gun assembly for emitting three electron beams is disposed, and a funnel formed contiguous to both the neck and the panel, and having a deflection yoke mounting portion on which a deflection yoke is mounted. The cross section of the deflection yoke mounting portion fulfills the following condition at the panel side end of the deflection yoke mounting portion.

$$1.0 \leq rh/rv \leq 1.3$$

where rh is a diameter of the funnel directed to a direction of a long axis of the panel, and rv is a diameter of the funnel directed to a direction of a short axis of the panel.

10 Claims, 5 Drawing Sheets

CATHODE RAY TUBE

BACKGROUND OF THE INVENTION

1. Field of the Invention

The present invention relates to a cathode ray tube (CRT) and more particularly, to a cathode ray tube capable of reducing the deflection power consumption.

2. Description of the Related Art

A CRT is a device for displaying image on a screen by vertically and horizontally deflecting electron beams generated from an electron gun and landing the deflected electron beams onto the phosphor layers formed on the screen. The deflection of the electron beam is controlled by a deflection yoke, which is mounted on the exterior surface of the funnel of the CRT, and forms vertical and horizontal magnetic fields. The CRTs are generally employed for color televisions (TVs), monitors and high definition televisions (HDTVs). With increasing use of the CRTs, there is a need for reducing the length of the CRT to increase the brightness of the displayed image and to reduce the size of the final products, such as TVs, monitors and HDTVs.

When reducing the length of the CRT, the electron beams should be deflected with wide-angles, and the deflection frequency and current supplied to the deflection yoke should be increased for the wide-angle deflections of the electron beams. As the deflection frequency and current increase, the deflection magnetic field tends to leak to the outside of the cathode ray tube and the power consumption increases.

In order to decrease deflection power and magnetic field leakage at the same time, it is conventionally preferable to decrease the neck diameter of the cathode ray tube and the outer diameter of the funnel near the neck on which the deflection yoke is mounted, so that the deflection field efficiently acts on the electron beams. However, when the neck diameter is simply decreased, there are some disadvantages including deterioration of the image resolution due to the reduced diameter of the electron gun, and likely bombardment of the inner wall of the funnel by the outer electron beams, resulting in the electron beams not properly landing on the phosphor layer of the screen.

In order to solve these problems, U.S. Pat. No. 3,731,129 discloses a funnel having a wider peripheral portion sealed to the periphery of the panel, and a deflection portion whose cross-sectional configuration gradually varies from a rectangular shape substantially similar to that of the rectangular image produced on the panel to a circular shape. Thereby, the vertical and horizontal coils of the deflection yoke are closely located to the passage of the electron beams, and deflect the electron beams with reduced deflection power and without bombarding the electron beams to the inner wall of the funnel. However, the funnel does not have enough strength to endure against external stress, such as pressure, thus the funnel has to be designed to have a circular or round cross section.

Meanwhile Japanese Laid Open Patent 9-306388 corresponding to U.S. Pat. No. 5,763,995 discloses a funnel, whose cross section of the exterior surface near the neck changes from a circular shape to a non-circular shape with a maximum diameter along a direction (diagonal direction) other than the horizontal direction or the vertical direction. In addition, the funnel is designed to meet the following condition.

$$0.3<\Delta HV/L\leqq 0.6$$

where L is the length of the maximum diameter, and ΔHV is the sum of ΔH and ΔV, and ΔH is a difference between L and the horizontal diameter of the cross-section of the funnel, and ΔV is the difference between L and the vertical diameter of the cross-section of the funnel. However, the funnel is defined or configured by three variables, ΔH, ΔV and L. Thus, for example, even though ΔH is set to a fixed value, two variables are not fixed or defined. As a result, it is difficult to design a funnel having the optimum configuration and enough strength against external stress.

Meanwhile, Japanese Laid Open Patent 10-149785 discloses a funnel whose cross section of the exterior surface is a non-circular shape with a maximum diameter along a direction (diagonal direction) other than the horizontal direction or the vertical direction. In addition, when the aspect ratio of the screen is M:N, the cross section of the funnel is designed to meet the following condition.

$$(M+N)/(2(M^2+N^2)^{1/2})<(SA+LA)/(2DA)\leqq 0.86$$

where SA is the vertical diameter of the external surface of the funnel, and LA is the horizontal diameter of the external surface of the funnel, and DA is the maximum diameter of the external surface of the funnel. Thus, the funnel is also defined by three variables, SA, LA and DA, and it is also difficult to design a funnel having the optimum configuration and enough strength against external stress.

SUMMARY OF THE INVENTION

The present invention is directed to a cathode ray tube which substantially obviates one or more of the problems resulting from the limitations and disadvantages of the related art.

An object of the present invention is to provide a cathode ray tube capable of minimizing the power consumption and preventing deflection magnetic fields from leaking to the outside of the cathode ray tube.

Another object of the present invention is to provide a cathode ray tube including a funnel having increased strength against external stress.

Further object of the present invention is to provide a cathode ray tube design, which is particularly suitable for flat-panel cathode ray tube.

To accomplish these and other advantages, the cathode ray tube includes a rectangular panel on which a phosphor screen is formed, a neck in which an electron gun assembly for emitting three electron beams is located, and a funnel formed contiguous to the neck on one side and the panel on the other, and having a deflection yoke mounting portion on which a deflection yoke is mounted. The cross section of the deflection yoke mounting portion meets the following condition at the panel side end of the deflection yoke mounting portion.

$$1.0\leqq rh/rv\leqq 1.3$$

where rh is the diameter of the funnel in the direction of the long axis of the panel, and rv is the diameter of the funnel in the direction of the short axis of the panel.

The objectives and other advantages of the invention will be realized and attained by the structure particularly pointed out in the written description and claims as well as the appended drawings. It is also to be understood that both the foregoing general description and the following detailed description are not intended to limit the scope of this invention, many variations of which will be apparent to those with ordinary skill in the art. The disclosure of the specific embodiments are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate a particular embodiment of the invention and, together with the description, serve to explain the principles of the invention. In the drawings.

DETAILED DESCRIPTION OF THE INVENTION

Reference will now be made in detail to the preferred embodiments of the present invention, examples of which are illustrated in the accompanying drawings.

Figure 1:
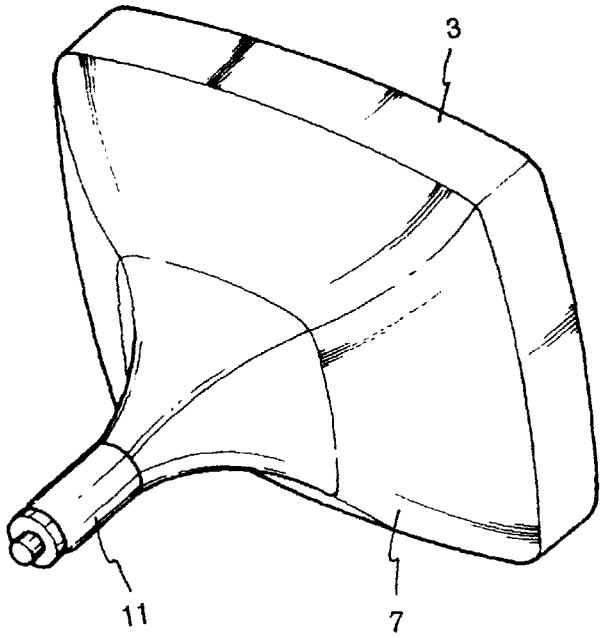
FIG. 1 is a perspective view of a cathode ray tube according to an embodiment of the present invention.
Figure 2:
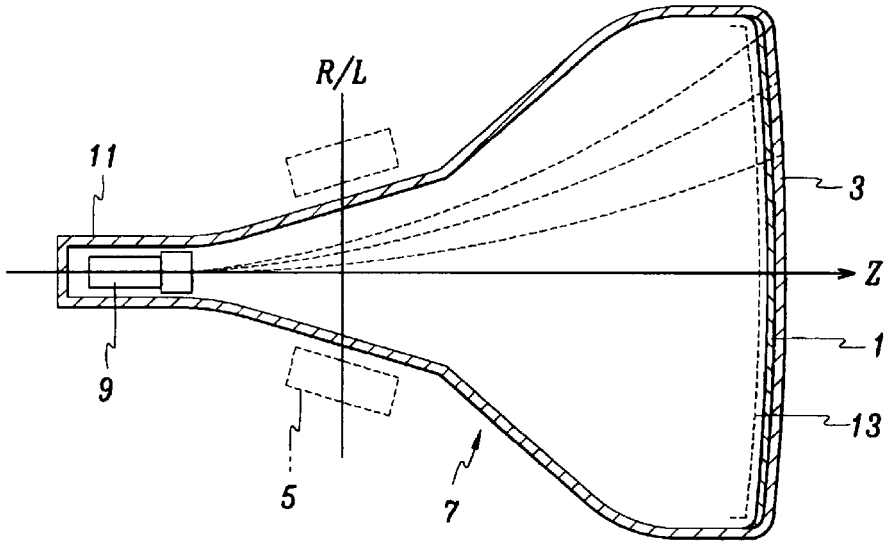
FIG. 2 is a cross-sectional view of a cathode ray tube according to an embodiment of the present invention, taken along a diagonal line of the panel of the cathode ray tube.

As shown in FIGS. 1 and 2, a cathode ray tube is a vacuumed envelope which is formed with a substantially rectangular panel 3, a funnel 7 formed contiguous to the panel 3, and a cylindrical neck 11 formed contiguous to the small-diameter end portion of the funnel 7. A phosphor screen 1 is formed on the inner surface of the panel 3. A deflection yoke 5 is mounted on the funnel 7 near the neck 11, and an electron gun assembly 9 for emitting three electron beams is located in the neck 11. The three electron beams emitted from the electron gun assembly 9 are deflected by horizontal and vertical deflection fields generated by the deflection yoke 5. The deflected electron beams reach the phosphor screen 1 through a shadow mask 13 mounted on the inner surface of the panel 3, and display a color image.

In order to effectively reduce the deflection power, the exterior surface of the funnel 7, on which the deflection yoke 5 is mounted, is designed to have a circular section at the position near the neck 11, and the circular cross-section gradually changes from the neck to the panel to have a non-circular section having a maximum diameter along a diagonal direction other than the horizontal and vertical directions, for example, a rectangular cross-section.

In addition, the funnel 7 is designed so that the cross section of the funnel 7 meets the following condition at the panel side end of the deflection yoke 5.

$$1.0 \leqq rh/rv \leqq 1.3$$

where rh is the diameter of the funnel in the direction of the long axis (horizontal diameter), and rv is the diameter of the funnel in the direction of the short axis (vertical diameter).

Figure 3:
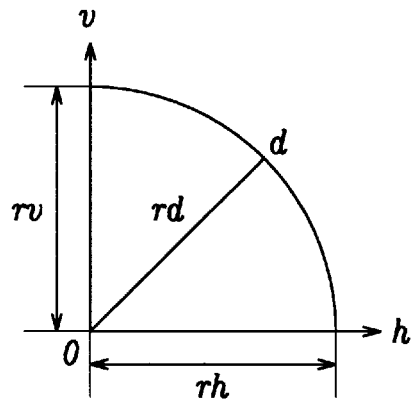
FIG. 3 is a schematic diagram for illustrating the cross section of the funnel at the neck side according to an embodiment of the present invention.

More preferably, the rh/rv value gradually decreases from the panel side to the neck side, and sets to 1.0 at the position where the funnel 7 connects with the neck 11. FIG. 3 is a schematic diagram for illustrating the cross section of the funnel 7 near the neck. As shown in FIG. 3, the diagonal diameter (rd) of the funnel in the direction of the diagonal axis (d) equals to the horizontal diameter (rh) of the funnel in the direction of the long axis (h) and the vertical diameter (rv) of the funnel in the direction of the short axis (v). Thus, the cross section has a circular shape.

Figure 4:
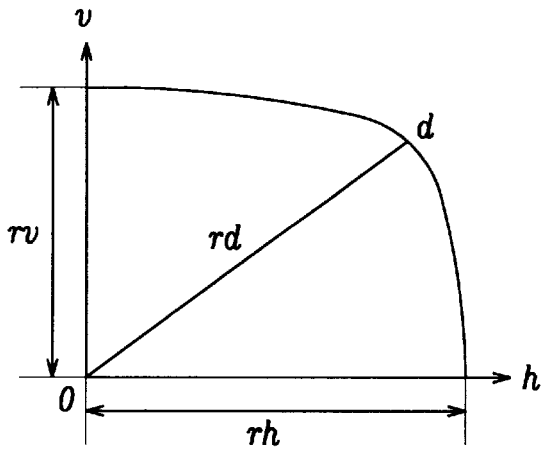
FIG. 4 is a schematic diagram for illustrating the cross section of the funnel, taken along a position at which a deflection yoke is mounted according to an embodiment of the present invention.

FIG. 4 is a schematic diagram for illustrating the cross section of the funnel 7 at which the deflection yoke 5 is mounted. As shown in FIG. 4, at the position on which the deflection yoke 5 is mounted, the horizontal diameter (rh) and the vertical diameter (rv) decrease to be shorter than the diagonal diameter (rd). Thus, the cross section has a rectangular shape.

The configuration of the funnel 7 of the present invention is derived by simulation tests to reduce the deflection power and to increase the BSN(beam strike neck) characteristics of the funnel 7 and the strength against external pressure.

More preferably, the funnel 7 is designed so that the cross section of the funnel 7 meets the following condition at the position of the deflection reference line (R/L).

$$1.1 \leqq rh/rv \leqq 1.2$$

where rh is the diameter of the funnel in the direction of the long axis, and rv is the diameter of the funnel in the direction of the short axis. As shown in FIG. 2, the reference line (R/L) is defined by elongating the trajectories of the outer electron beams, which escape from the effect of the deflection yoke 5, and by calculating the crossing point of the elongated trajectories. Thus, the reference line is formed at the middle and center portion of the deflection yoke 5.

Figure 5:
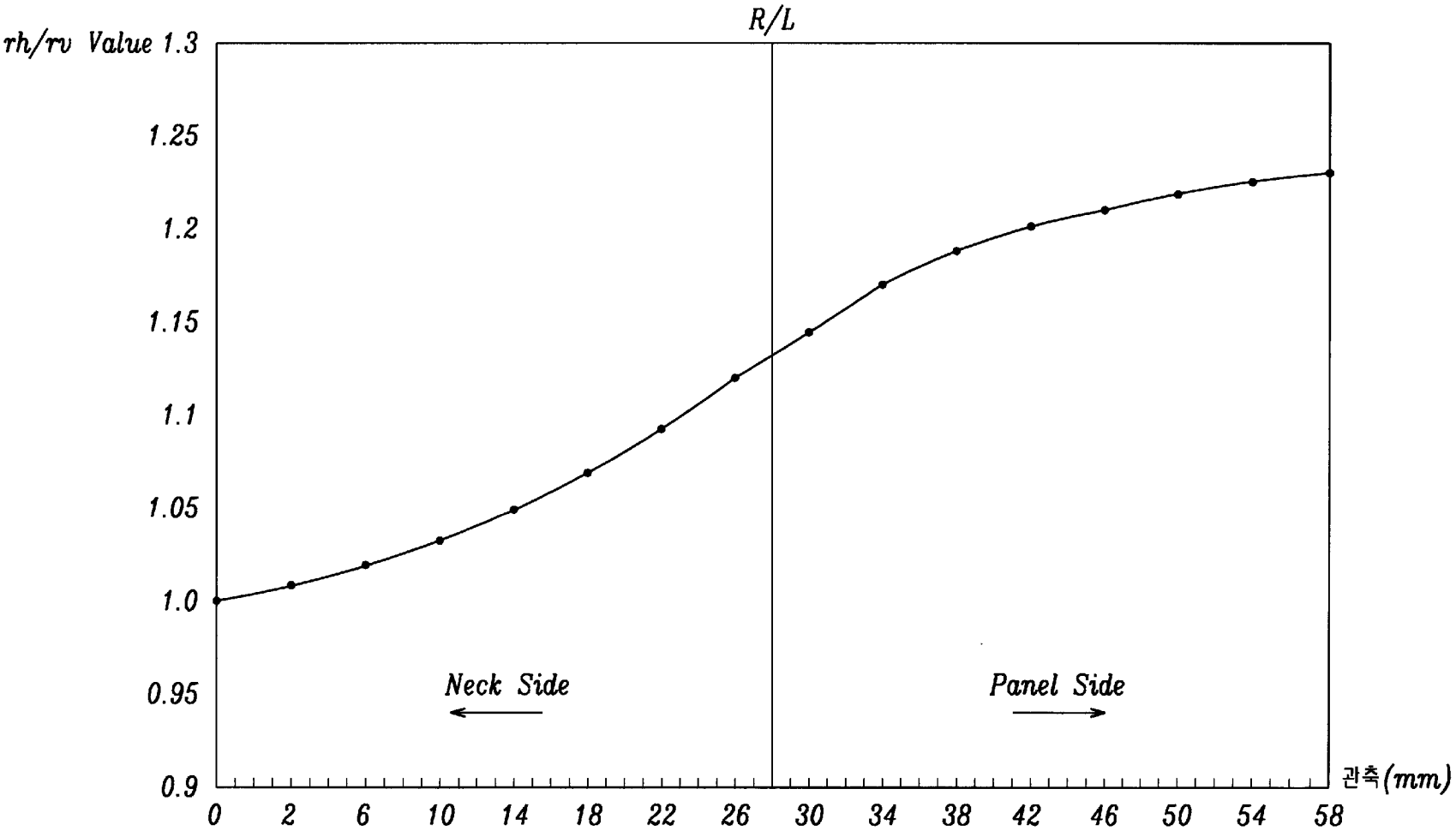
FIG. 5 is a graph for illustrating the change of rh/rv value according to the distance from the neck.
Figure 6:
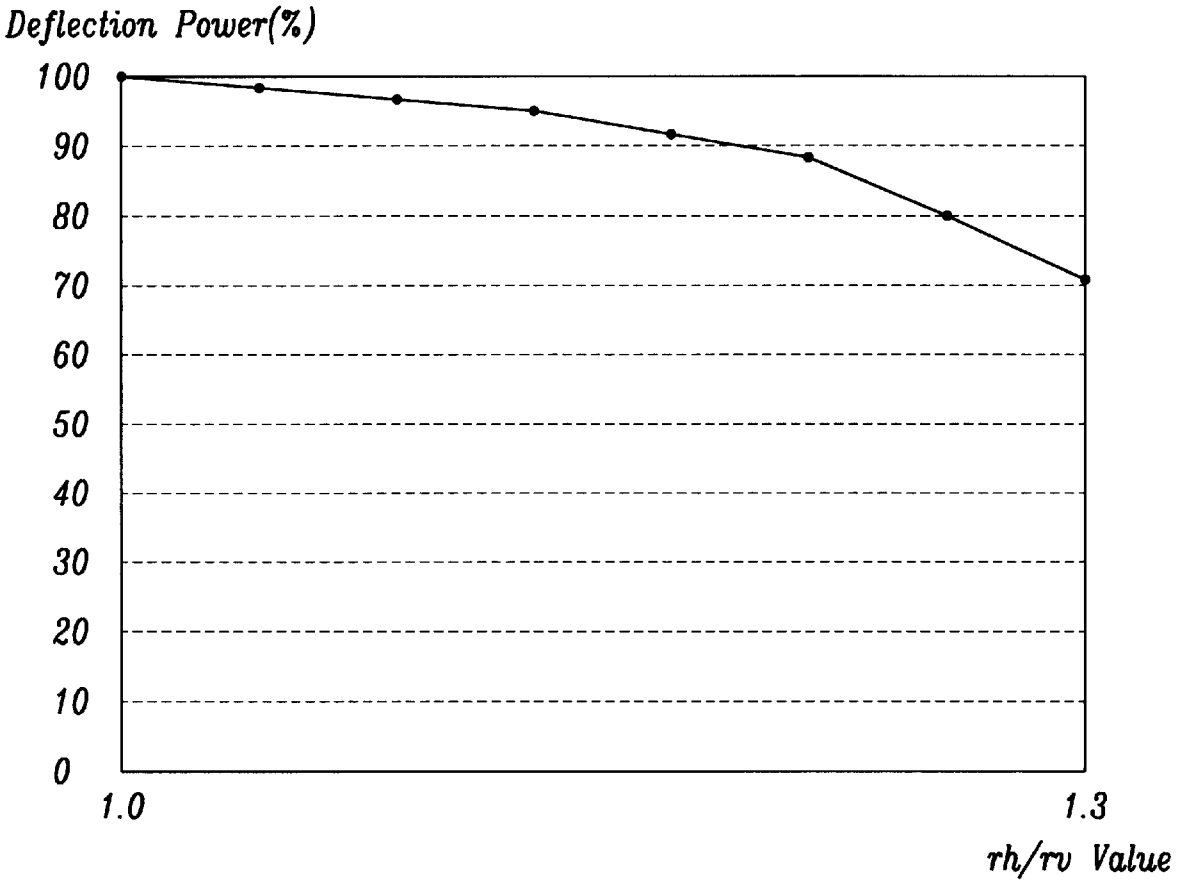
FIG. 6 is a graph for illustrating the relation of the deflection power and the rh/rv value.
Figure 7:
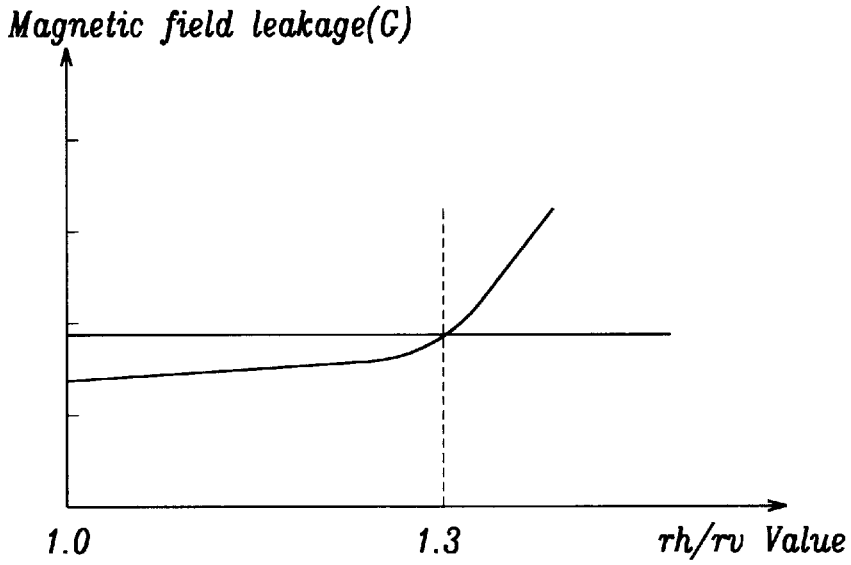
FIG. 7 is a graph for illustrating the relation of the magnetic field leakage and the rh/rv value.

FIG. 5 is the graph for illustrating dimensional characteristics of the funnel 7 according to the present invention, and shows the change of rh/rv value of the funnel 7 along the tube axis of the funnel 7. In the funnel 7 shown in FIG. 5, the rh/rv value at the reference line is 1.14, and the exterior surface of the funnel 7 is convexed to the tube axis before the reference line (R/L), and the exterior surface is concaved to the tube axis after the reference line (R/L), FIG. 6 is a graph for illustrating the relationship between deflection power and the rh/rv value. As shown in FIG. 6, as the rh/rv value increases from 1.0 to 1.3, the deflection power of the cathode ray tube gradually decreases. In addition, as shown in FIG. 7, when the rh/rv value is less than 1.3, the magnetic field leakage is maintained below a predetermined value (horizontal line in FIG. 7).

The present invention is particularly suitable for wide-angle deflection cathode ray tube in which the deflection angle is 90° or 100°. In detail, the rh/rv value is preferably maintained between 1.0 and 1.3 when the deflection angle is 90°, and the rh/rv value is preferably maintained between 1.0 and 1.25 when the deflection angle is 100°.

By configuring the shape of the funnel according to the present invention, the cathode ray tube of the present invention has enough strength against the external pressure and consumes less deflection power, and the magnetic field leakage is prevented.

It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents. This application is based on application No. 98-38811 filed in Korean Industrial Property Office on Sep. 19, 1998, the content of which is incorporated herein by reference.

What is claimed is:

1. A cathode ray tube comprising:

a rectangular panel on which a phosphor screen is formed;

a neck in which an electron gun assembly for emitting three electron beams is disposed; and a funnel formed contiguous to both the neck and the panel, and having a deflection yoke mounting portion on which a deflection yoke is mounted, wherein a cross section of the deflection yoke mounting portion fulfills the following condition at the panel side end of the deflection yoke mounting portion $$1.0 \leqq rh/rv \leqq 1.3$$

where rh is a diameter of the funnel directed to a direction of a long axis of the panel, and rv is a diameter of the funnel directed to a direction of a short axis of the panel.

2. The cathode of ray tube according to claim 1, wherein the rh/rv is value gradually decreases from the panel side to the neck side.

3. The cathode of ray tube according to claim 2, wherein the cross section of the funnel fulfills the following condition at a deflection reference line $$1.1 \leqq rh/rv \leqq 1.2$$

where rh is a diameter of the funnel directed to the direction of the long axis, and rv is a diameter of the funnel directed to the direction of the short axis.

4. The cathode of ray tube according to claim 1, wherein the cross section of the funnel fulfills the following condition at a deflection reference line $$1.1 \leqq rh/rv \leqq 1.2$$

where rh is a diameter of the funnel directed to the direction of the long axis, and rv is a diameter of the funnel directed to the direction of the short axis.

5. A cathode ray tube comprising:

a rectangular panel having a phosphor screen;

a neck having an electron gun assembly disposed therein for emitting three electron beams;

a funnel having an end contiguous to the neck, an opposite end contiguous to the panel, a deflection yoke mounting portion, and a deflection yoke mounted on said deflection yoke mounting portion, said deflection yoke mounting portion comprising a cross-section having a first diameter rh and a second diameter rv transversing the first diameter rh, wherein the cross-section at an end closest to the panel satisfies $$1.0 \leqq rh/rv \leqq 1.3.$$

6. The cathode of ray tube according to claim 5, wherein the rh/rv decreases from the end closest to the panel to an end closest to the neck.

7. The cathode of ray tube according to claim 6, wherein a cross-section of the deflection yoke mounting portion at a deflection reference line satisfies $$1.1 \leqq rh/rv \leqq 1.2.$$

8. The cathode ray tube of claim 7, wherein said deflection reference line is an imaginary line extending through trajectories of outer electron beams which escape from effects of the deflection yoke.

9. The cathode ray tube according to claim 5, wherein a cross-section of the deflection yoke mounting portion at a deflection reference line satisfies $$1.1 \leqq rh/rv \leqq 1.2.$$

10. The cathode ray tube of claim 9 wherein said the deflection reference line is an imaginary line extending through trajectories of outer electron beams which escape from effects of the deflection yoke.

* * * * *